US005172030A

United States Patent [19]

Pitt et al.

[11] Patent Number: 5,172,030

[45] Date of Patent: Dec. 15, 1992

[54] MAGNETRON

[75] Inventors: Ian D. Pitt, Chelmsford; Paul A. Jerram, Braintree; John W. Kerr, Witham, all of United Kingdom

[73] Assignee: EEV Limited, Essex, United Kingdom

[21] Appl. No.: 296,465

[22] Filed: Jan. 12, 1989

[30] Foreign Application Priority Data

Jan. 20, 1988 [GB] United Kingdom ..... 8801176

[51] Int. Cl.[5] ..... H01J 1/16

[52] U.S. Cl. ..... 315/39.51; 313/346 R

[58] Field of Search ..... 315/39.51, 39.53, 39.57, 315/39.63, 39.67, 5, 13; 313/346 R, 340, 337, 338

[56] References Cited

U.S. PATENT DOCUMENTS

| | | | |
|---|---|---|---|
| 2,653,268 | 9/1953 | Kumpfer | 313/346 R |
| 3,297,901 | 1/1967 | MacDonald et al. | 313/340 |
| 3,441,779 | 4/1969 | Hübner | 313/346 R |
| 3,477,110 | 11/1969 | Honeyball | 313/340 |
| 3,514,661 | 5/1970 | Reaves | 313/346 R |
| 3,821,589 | 6/1974 | Katz et al. | 313/346 R |
| 4,429,250 | 1/1984 | Clerc et al. | 313/346 R X |

FOREIGN PATENT DOCUMENTS

| | | | |
|---|---|---|---|
| 1491342 | 11/1969 | Fed. Rep. of Germany . | |
| 0109364 | 8/1979 | Japan | 315/39.51 |
| 0162954 | 12/1979 | Japan | 313/346 R |
| 527145 | 10/1940 | United Kingdom . | |
| 633841 | 12/1949 | United Kingdom . | |
| 761684 | 11/1956 | United Kingdom . | |
| 766881 | 1/1957 | United Kingdom . | |
| 783836 | 10/1957 | United Kingdom . | |
| 1141495 | 1/1969 | United Kingdom . | |
| 2109625 | 6/1983 | United Kingdom . | |
| 2141869 | 1/1985 | United Kingdom . | |

OTHER PUBLICATIONS

"Patent Abstracts of Japan", unexamined applications, E field, vol. 10, No. 50, Feb. 27, 1986, p. 126 E 384, Kokai-No. 60-205 943.

"Patent Abstracts of Japan", unexamined applications, E field, vol. 8, No. 209, Sep. 22, 1984, p. 8 E 268, Kokai-No. 59-94 330.

*Primary Examiner*—Eugene R. LaRoche
*Assistant Examiner*—Seung Ham
*Attorney, Agent, or Firm*—Spencer, Frank & Schneider

[57] ABSTRACT

A magnetron includes a cathode assembly which comprises a helically wound wire supported by a ceramic cylindrical member. Emissive material is located between adjacent turns of the conductor and connection is provided to the conductor via a rod and tube. When current is passed through the conductor (2), the emissive material (4) is directly heated.

1 Claim, 2 Drawing Sheets

MAGNETRON

BACKGROUND OF THE INVENTION

This invention relates to magnetrons and more particularly to magnetron cathodes.

The time required for a magnetron to become operational is governed by the warm-up time of its cathode, that is, the time required for the cathode to reach an operating temperature at which suficient electrons are emitted for proper operation to be achieved. The present invention arose in an attempt to provide a magnetron having a cathode with a short warm-up time.

SUMMARY OF THE INVENTION

According to the invention, there is provided a magnetron including a cathode which comprises an electrical conductor wound on an electrically insulating member and electron emissive material located adjacent the conductor such that, when current is passed through the conductor, the emissive material is directly heated. As the conductor is in direct contact with the emissive material, heating it to the operating temperature is readily achieved. It is preferred that the conductor is helical, as this configuration has particularly satisfactory operational characteristics. The conductor may be coated with electron emissive material, such a structure having a low heat capacity and therefore enabling warm-up times to be improved However, in a preferred embodiment of the invention, the electrical conductor is wound on a member of electrically insulating material. This enables heat losses to be reduced still further, giving a greater reduction in warm-up time and also enables a rigid structure to be achieved which therefore has good electrical stability. Preferably, the member is a ceramic cylinder. The member may include a groove in which the conductor is at least partially located, and emissive material may be held in position by the walls of the groove or by adjacent parts of the conductor.

Advantageously, where the conductor is helical, electron emissive material is located between adjacent turns of the conductor. Emissive material is therefore heated by two adjacent turns and the helical conductor ensures that the electrical field between the magnetron cathode and anode is kept constant as the emissive coating evaporates.

BRIEF DESCRIPTION OF THE DRAWINGS

Some ways in which the invention may be performed are now described by way of example with reference to the accompanying drawings, in which.

DETAILED DESCRIPTION OF PREFERRED EMBODIMENTS

Figure 1:
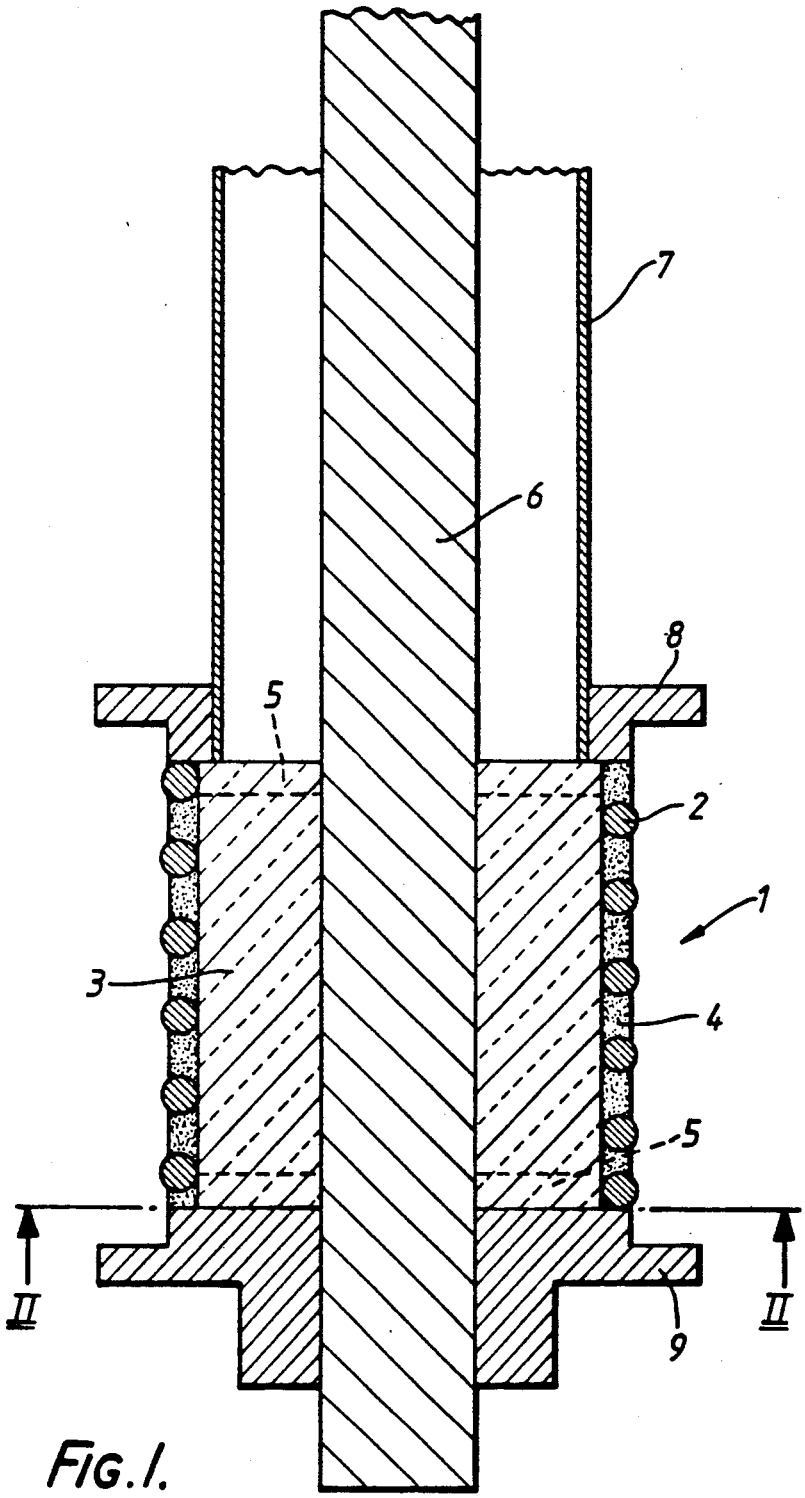
FIG. 1 is a schematic sectional diagram of part of a magnetron in accordance with the invention.
Figure 2:
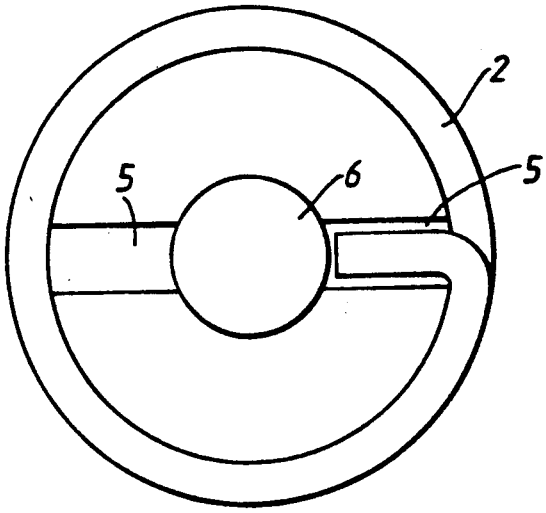
FIG. 2 is a view along the line II—II of FIG. 1

With reference to FIG. 1, a magnetron includes a cathode indicated generally at 1 which comprises a helically wound wire 2 of tungsten rhenium which is supported by a ceramic cylindrical member 3. Electron emissive material 4, which is a mixture of oxides of barium, strontium and calcium, is laid down between the turns of the helical conductor 2 so that it fills the spaces between them. The ceramic member 3 includes a slot 5 at each end, as shown in FIG. 2, in which the ends of the helical conductor 2 are located and fixed. Connection to the lower end as shown of the conductor 2 is made via a nickel rod 6, which passes through the member 3 along its axis, and a metallised region on the member 3 in the region of the slot 5. The connection to the upper part of the conductor 2 is made via a nickel tube 7 which is located coaxially about the rod 6. Nickel end caps 8 and 9, located at the ends of the member 3, hold the assembly together.

Figure 3:
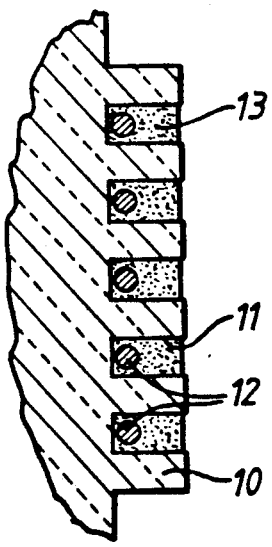
FIG. 3 is a schematic sectional diagram of part of another magnetron in accordance with the invention.

With reference to FIG. 3, in another magnetron in accordance with the invention, the magnetron cathode includes a cylindrical ceramic member 10 which has a helical groove 11 in its outer curved surface. A conductor 12 is wound around the ceramic member 10, being located in the groove 11. Electron emissive material 13 is also included in the groove 11 and is arranged to surround the conductor 12.

Figure 4:
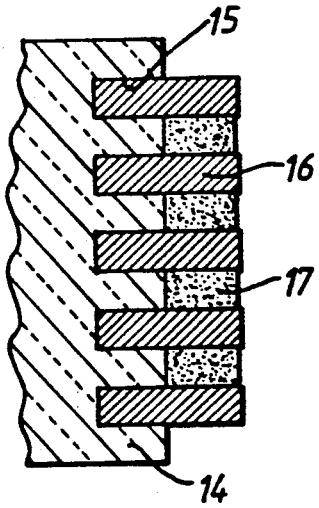
FIG. 4 is a schematic sectional drawing of part of another magnetron.

With reference to FIG. 4, in another advantageous embodiment of the invention, a ceramic member 14 includes a helical groove 15 in its outer curved surface similar to that shown in FIG. 3. A rectangular section conductor 16 is wound in the groove such that part of it stands proud of the ceramic surface. Electron emissive material 17 is coated between the portions of the conductor 16 which are extensive from the ceramic surface. Of course, although a rectangular section conductor is used in this embodiment of the invention, other configurations could be used.

We claim:

1. A magnetron including a cathode comprising:

a cylindrical electrically insulating member having an outer curved surface of said insulating member;

an electrical conductor wound in said helical groove; and electron emissive material located adjacent to said electrical conductor directly heating said electron emissive material when a current is passed through said electrical conductor, wherein a raised portion of said electrical conductor extends outwardly from said helical groove, and said electron emissive material is disposed between adjacent raised portions of said electrical conductor on said outer curved surface of said insulating member.

* * * * *